US006361297B1

(12) United States Patent
Hugenroth

(10) Patent No.: US 6,361,297 B1
(45) Date of Patent: Mar. 26, 2002

(54) SCROLL COMPRESSOR WITH PIVOTING SLIDER BLOCK AND IMPROVED BORE CONFIGURATION

(75) Inventor: Jason Hugenroth, Hope, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/662,959

(22) Filed: Sep. 15, 2000

(51) Int. Cl.[7] ..... F04C 18/04
(52) U.S. Cl. ..... 418/55.5; 418/57
(58) Field of Search ..... 418/55.5, 57

(56) References Cited

U.S. PATENT DOCUMENTS 5,772,415 A * 6/1998 Monnier et al. ..... 418/55.5
6,179,592 B1 * 1/2001 Hugenroth et al. ..... 418/55.5
6,203,300 B1 * 3/2001 Williams et al. ..... 418/55.5

* cited by examiner

*Primary Examiner*—John J. Vrablik
(74) *Attorney, Agent, or Firm*—Carlson, Gaskey & Olds

(57) ABSTRACT

A scroll compressor includes an eccentric pin extending into a slider block, wherein the bore of the slider block is configured to cause the orbiting scroll to move out of contact with the non-orbiting scroll when there is reverse rotation. The bore in the slider block is configured to have two distinct circular portions. One of the circular portions has a greater radius than the other. The portion with the greater radius provides space to accommodate pivoting movement of the slider block relative to the eccentric pin when reverse rotation occurs. The second portion having the smaller radius ensures that a pivot pin on the inner periphery of the slider block bore is relatively thick.

3 Claims, 2 Drawing Sheets

SCROLL COMPRESSOR WITH PIVOTING SLIDER BLOCK AND IMPROVED BORE CONFIGURATION

BACKGROUND OF THE INVENTION

This application relates to a scroll compressor wherein the slider block is configured such that the orbiting scroll will have its wrap flank surface moved out of contact with the wraps of the non-orbiting scroll in the event there is reverse rotation.

Scroll compressors are becoming widely utilized in refrigerant compression applications. In a scroll compressor, a first scroll member has a base and a generally spiral wrap extending from the base. A second scroll member has a base and a generally spiral wrap extending from its base. The two wraps interfit to define compression chambers. A shaft is connected through a slider block to drive the second scroll member to orbit relative to the first scroll member. The drive arrangement for the second scroll member is such that the wraps of the two scroll members are biased into contact with each other such that a seal is provided.

One problem with scroll compressors occurs when the second scroll member is driven in a reverse direction to that which is desirable. Such reverse rotation has some undesirable side effects, and it would be desirable to reduce those side effects.

In a patent application Ser. No. 09/310,545, U.S. Pat. No. 6,179,592, an arrangement is disclosed wherein a slider block pivots relative to an eccentric pin on a drive shaft in the event there is reverse rotation. With such movement the orientation of the second scroll member relative to the first changes, and the wraps are no longer held in contact. In this way, compression chambers are not defined, and the side effects of reverse rotation are reduced.

It is an object of this invention to improve upon the disclosed configurations from the above-referenced application.

SUMMARY OF THE INVENTION

In a disclosed embodiment of this invention, a scroll compressor has a slider block with a bore which receives an eccentric pin from a driveshaft. The bore of the slider block is configured such that it has a flat surface which mates with a flat surface on the eccentric pin when the shaft is driven in a forward direction to transmit movement to the slider block and hence the orbiting scroll. In this direction, the orbiting scroll wrap is held in contact with the non-orbiting scroll wrap.

In the event the shaft is driven in an opposed direction, then the slider block moves to a position where a pivot point on the slider block contacts the eccentric pin from the shaft. At that point, the slider block begins to pivot relative to the eccentric pin and the orbiting scroll wrap is moved out of contact with the non-orbiting scroll wrap.

In a preferred embodiment of this invention, the structure of the bore is optimized to have a flat portion for providing a drive surface under forward rotation, and a pair of circular portions on each side of the flat portion. The circular portions are centered on different radii on each side of the pivot pin. The radius on the direction through which the slider block will pivot in the event of reverse rotation is greater than the radius on the opposed side. The greater radius will provide additional space to allow for the pivoting movement. The smaller radius on the opposed side will allow the pivot pin to be relatively thick. If the radii were equal on each side, then the provision of necessary space for pivoting movement would result in the pivot pin being relatively smaller.

In further features of this invention the pivot pin has a unique shape including a ramped surface in a direction opposed to the pivotal movement.

These and other features of the present invention can be best understood from the following specifications and drawings, the following of which is a brief description.

DETAILED DESCRIPTION OF A PREFERRED EMBODIMENT

Figure 1:
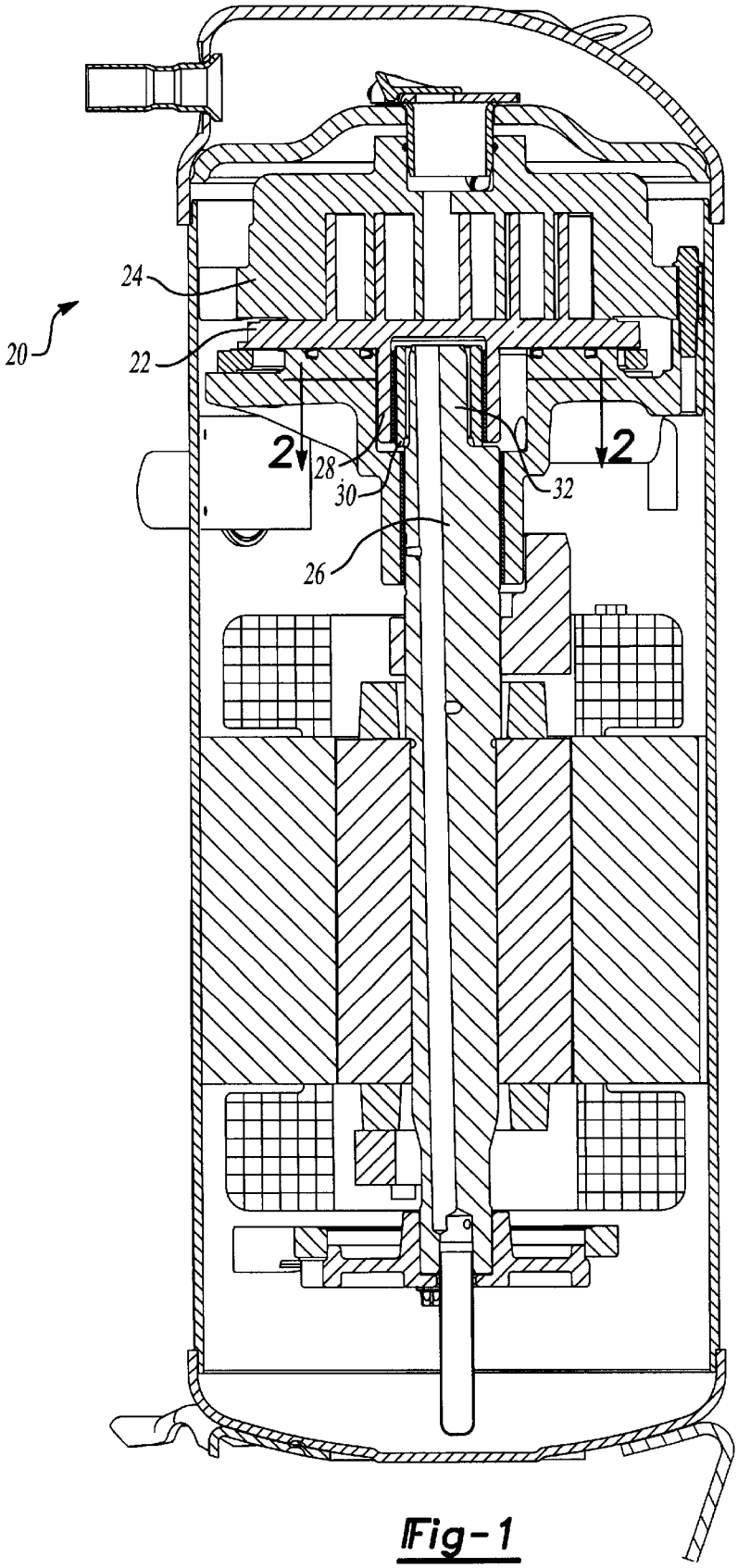
FIG. 1 shows a cross-sectional view through a scroll compressor incorporated in the present invention.

Scroll compressor 20 is shown in FIG. 1 having an orbiting scroll 22 and a non-orbiting scroll 24. As known, a shaft 26 drives the orbiting scroll 22 to orbit relative to the non-orbiting scroll. The orbiting scroll 22 has a downwardly extending boss 28 which receives a slider block 30. An eccentric pin 32 from the shaft 26 moves upwardly into a bore in the slider block 30. As is known, if the shaft 26 is rotated in a forward direction, the orbiting scroll 22 will orbit in a proper direction relative to the non-orbiting scroll 24 and an entrapped refrigerant will be compressed.

However, if the shaft 26 is driven to orbit in a reverse direction, undesirable side effects can occur. Moreover, in certain cases at shutdown of the shaft 26, the orbiting scroll 22 can be driven to rotate in a reverse direction also.

Figure 2:
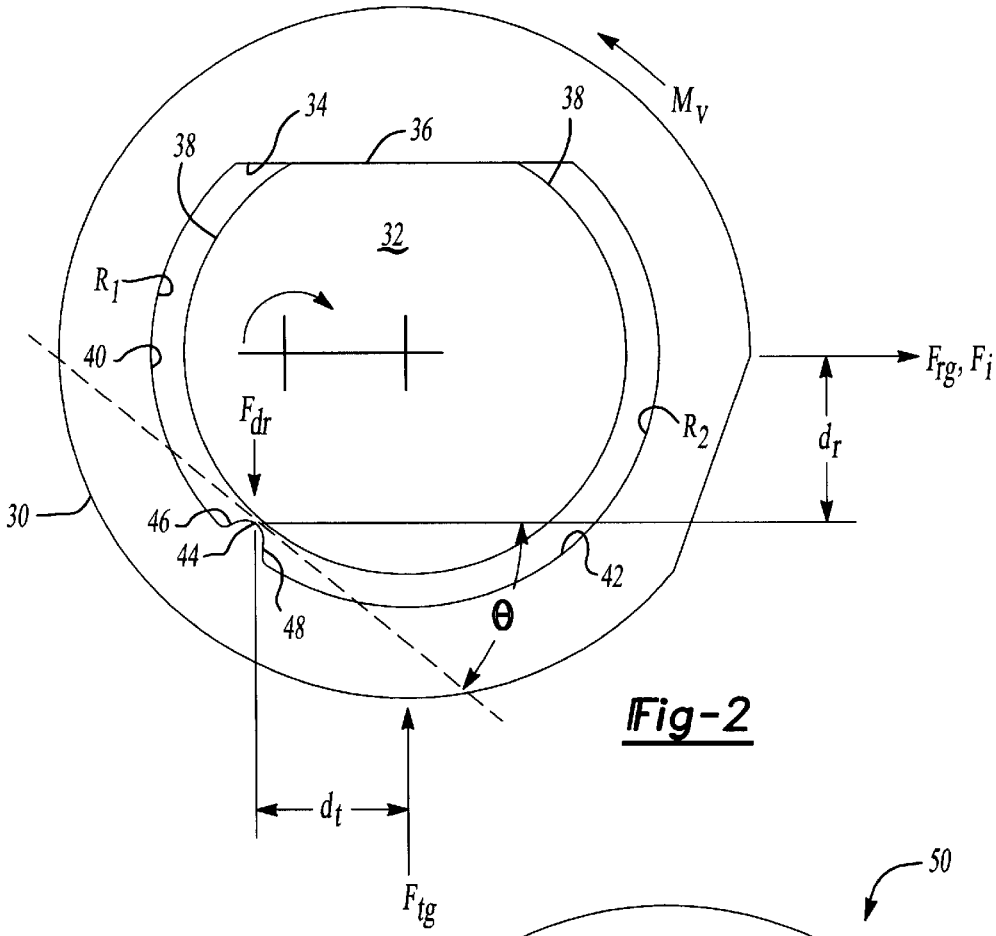
FIG. 2 is a cross-sectional view along line 2—2 of FIG. 1.
Figure 3:
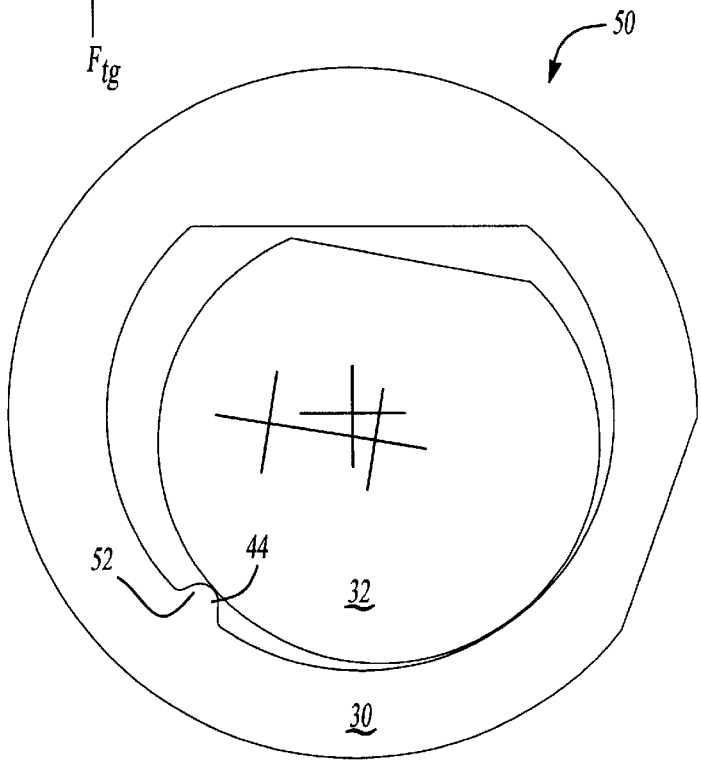
FIG. 3 shows the FIG. 2 structure having pivoted to its nonengaged position.

FIGS. 2 and 3 show an arrangement wherein the flanks of the wraps of the scroll members 22 and 24 are moved out of contact with each other in the event that reverse rotation occurs. In this way, there will be no entrapped refrigerant during any reverse rotation.

As shown in FIG. 2, during forward rotation the eccentric pin 32 is driven against a flat surface 34 on an interior bore of the slider block 30. The eccentric pin 32 has its own flat surface 36 which is in contact with surface 34. In this position the slider block is held such that it will hold the orbiting scroll wrap in contact with the non-orbiting scroll wrap, and refrigerant can be compressed. As shown, when reverse rotation occurs a tangential gas force Ftg is applied to the slider block at a point a distance dt from a pivot point 44. This force tends to cause the slider block 30 to pivot in a counterclockwise direction by creating a moment Mv. At the same time, a second moment $(F_i+F_{rg})d_r$ is created which forces the slider block 30 in the clockwise direction. During forward rotation the second moment and the moment $M_v$ are in the clockwise direction. Thus, the slider block is held at the position illustrated in FIG. 2.

As shown in FIG. 3, when reverse rotation occurs, the moment $M_v$ exceeds the moment from the $F_{rg}$ and $F_i$ forces. The slider block 30 then pivots to the position such as shown in FIG. 3. In this position, the flanks of the wraps of the orbiting scroll 22 are held out of contact with the wraps of the non-orbiting scroll 24. Thus, refrigerant is not entrapped.

The inventive features of this application relate to the shape of the bore in the slider block 30. As shown, the eccentric pin 32 has a circular surface 38 extending from each end of the flat 36. The slider block 30 has a first circular portion 40 on one side of a pivot point 44 and a second circular portion 42 on an opposed side. Portion 40 has a radius $R_1$ and portion 42 has a larger radius $R_2$. The pivot pin 44 has a ramped surface 46 facing the surface 40 and a generally flat surface 48 extending at a slight angle radially outwardly on a side facing surface 42. When the slider block 30 moves from the FIG. 2 position to the FIG. 3 position, the use of the larger radius 42 provides for additional space to facilitate the movement and adjustment during reverse rotation. On the other hand, the use of the smaller radius $R_1$ for the surface 40 ensures that there is additional material such as shown generally in the area 52 in FIG. 3 which allows the pivot pin 44 to be relatively thick and more robust. Without this additional material it is possible the pivot pin 44 could be too delicate, and could break during use.

A worker in this art would recognize that certain modifications come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap extending from its base, said wraps of said first and second scroll members interfitting to define compression chambers, and said second scroll member being caused to orbit relative to said first scroll member by a driveshaft;

said driveshaft including an eccentric pin extending upwardly into a bore in a slider block, said slider block being received in a bore in a downwardly extending boss connected to said orbiting scroll; and said eccentric pin and said slider block having structure to cause movement such that when said shaft rotates in a first direction a flat surface on said eccentric pin engages a flat surface on said slider block and said wraps of said first and second scroll members are held in contact with each other to define said compression chambers, and wherein when said shaft rotates in a second direction opposed to said first direction, said flat surfaces move out of engagement and said slider block is caused to pivot relative to said eccentric pin about an integral pivot pin in said slider block bore at an inner peripheral portion, and an arcuate portion on one circumferential side of said pivot point having a first radius, and a second arcuate portion on an opposed side of said pivot pin having a second radius, said second portion moving toward said eccentric pin when said shaft is driven in said second direction, and said second radius being greater than said first radius.

2. A scroll compressor as recited in claim 1, wherein said first radius being smaller allows said pivot pin to be relatively thick on a side of said pivot pin facing said first portion relative to said second portion.

3. A scroll compressor as recited in claim 2, wherein said pivot pin has a generally thick ramped portion on said first side, and a generally radially outwardly extending ramped portion on a second side.

* * * * *